United States Patent [19]

Fujimori

[11] 3,934,402

[45] Jan. 27, 1976

[54] STRUCTURE OF BEZEL PORTIONS OF WATER-TIGHT TIMEPIECE

[76] Inventor: Yoshiaki Fujimori, 3091-1 Konan Suwa, Nagano-ken, Japan

[22] Filed: Dec. 5, 1974

[21] Appl. No. 529,882

[30] Foreign Application Priority Data

Dec. 5, 1973 Japan ..... 48-138866

[52] U.S. Cl. ..... 58/90 R

[51] Int. Cl. ..... G04B 37/08

[58] Field of Search ..... 58/90 R, 91

[56] References Cited

UNITED STATES PATENTS

| | | | |
|---|---|---|---|
| 2,514,906 | 7/1950 | Steimann | 58/90 R |
| 3,858,388 | 1/1975 | Fujimori et al. | 58/90 R |

*Primary Examiner*—George H. Miller, Jr.

*Attorney, Agent, or Firm*—Blum Moscovitz Friedman & Kaplan

[57] ABSTRACT

An improved water-tight mounting for a timepiece comprising an annular crystal having a chamfered surface on the exterior edge thereof, a bezel including a stepped crystal support engaging the chamfered surface of the crystal and an interior annular groove corresponding to the vertical edge of the crystal, a gasket in the annular groove abutting the vertical edge of the crystal, a crystal bearing ring supported between the gasket and a bearing surface provided in the timepiece case body, the ring being located interiorly in the mounting relative to the bezel and another gasket between the case body and bezel for providing a water-tight seal therebetween.

1 Claim, 2 Drawing Figures

STRUCTURE OF BEZEL PORTION OF WATER-TIGHT TIMEPIECE

BACKGROUND OF THE INVENTION

This invention relates to an improved water-tight mounting for a watch case, and more particularly to a novel bezel therefor.

It has been conventional to join the crystal of a watch to a frame therefor by an adhesive material, such as cement. However, it is found that as the cement ages, it undergoes dimensional changes and the bond between frame and crystal deteriorate to an extent that water, either liquid or gas phase, penetrates the cement seal.

It is also found that when the cemented crystal breaks or is otherwise defaced, it is necessary to replace the frame as well as the crystal. Therefore, it would be desirable to provide a water-tight mounting wherein the crystal may be replaced without concomitantly replacing the frame therefor, and without disturbing the water-tight joint therebetween during the replacement process.

Therefore, according to the instant invention, an improved water-tight mounting is provided wherein a broken crystal may be easily and readily replaced without disturbing the water-tight joints among elements of the mounting. A novel bezel is provided for releasably connecting the crystal to the watch casing and providing a water-tight seal therebetween.

SUMMARY OF THE INVENTION

Generally speaking, in accordance with the invention, an improved water-tight mounting for a timepiece is provided which comprises an annular crystal having a chamfered surface on the exterior edge thereof, a bezel including a stepped crystal support engaging the chamfered surface of the crystal and an interior annular groove corresponding to the vertical edge of the crystal, a gasket mounted in the annular groove and abutting the vertical edge of the crystal, a crystal bearing ring supported between the gasket and a bearing surface provided in the timepiece case body, which underlies the crystal, the ring being located interiorly in the mounting relative to the bezel and another gasket between the case body and bezel for providing a water-tight seal therebetween.

Accordingly, it is an object of this invention to provide an improved water-tight mounting for a timepiece.

Another object of the invention is to provide a novel bezel for releasably connecting the watch crystal to the case body thereof.

A further object of the invention is to provide a water-tight mounting for a timepiece wherein a broken watch crystal may be replaced without concomitant replacement of other elements thereof.

Still another object of the invention is to provide a water-tight mounting for a timepiece wherein a broken crystal may be replaced without any loss of the water-tightness thereof.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
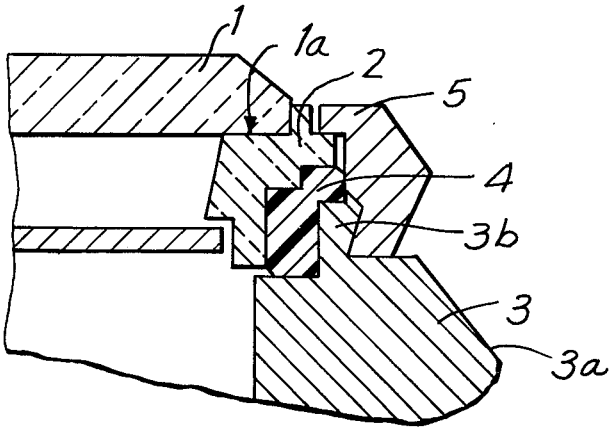
FIG. 1 PRIOR ART
FIG. 1 is a sectional view of a conventional water-tight mounting for a timepiece.

Referring now to FIG. 1, which is illustrative of the prior art, a crystal 1 is adhesively connected to a frame 2 along the underside surface 1*a* thereof. Compressed against the stepped exterior surface of frame 2 is a correspondingly stepped gasket 4. Underlying crystal 1 and frame 2 is a case body 3 having an upstanding rib 3*b* compressively engaged in the instep provided in gasket 4 by a snap-fit bezel 5 releasably connected thereto. An annular rim of bezel 5 overlies a bearing surface of frame 2 provided therefor and the other end thereof is releasably connected to case body 3 abutting rib 3*b* thereof.

In a conventional structure of the type disclosed, a strong adhesive connection must be provided between crystal 1 and frame 2 for thereby providing a water-tight seal therebetween. Accordingly, crystal 1 and frame 2 must be provided with correspondingly large adhesion surface areas for obtaining a seal of substantially uniform strength therebetween. Since the area of adhesion is necessarily large, it is visible through the crystal whereby an uneven distribution thereof or discoloration thereof may be observed through the crystal, thereby spoiling the appearance of the timepiece. Additionally, the adhesive seal contributes to the water-tightness of the timepiece and the adhesive coating and fixing process is therefore finite and complex.

If the crystal of a watch having this type of conventional construction breaks after purchase, then the crystal and frame must be replaced as a unit. No method for replacing a broken crystal in situ has been developed whereby the water-tightness of the timepiece is maintained. A further disadvantage of timepieces including this conventional mounting relates to the size of the timepiece. Because of the large surface area of adhesion that must be provided, compact timepieces including this conventional type mounting cannot be fabricated with suitable water-tightness.

In another conventional type of water-tight mounting for a timepiece, a gasket respectively overlies the case body of the watch and underlies the crystal thereof. The gasket is compressed vertically inwardly by a bezel releasably connected to the crystal. No adhesive is required in this mounting for water-tightness. However, the aesthetic appearance of the timepiece is impaired by the necessarily large dimensions of the bezel employed.

Figure 2:
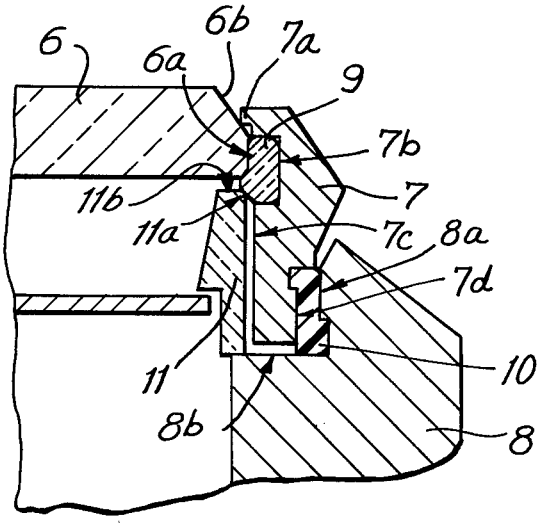
FIG. 2 is a sectional view of an improved water-tight mounting for a timepiece constructed in accordance with the instant invention.

Referring now to FIG. 2, a transparent crystal 6 is releasably mounted on a case body 8 by a gasketted bezel 7 and a bearing ring 11. Crystal 6 is provided with a peripheral surface 6*a* substantially parallel to the axis of the timepiece. The top surface of crystal 6 is chamfered along the edge 6*b* thereof at its intercept with vertical peripheral surface 6*a*.

Bezel 7 is provided with an instep 7*a* which overhangs chamfered edge 6*b* of crystal 6 and an edge of the step thereof releasably engages crystal 6 along chamfered edge 6*b*. In bezel 7 and below instep 7*a* thereof, a gasket seat is provided by an annular groove 7*b*. Surface 6*a* of the crystal corresponds with annular groove 7*b* and a gasket 9 seated in groove 7*b* abuts crystal 6 along surface 6*a* thereof. Proximate the interior surface 7*c* of the bezel, a bearing ring 11 is releasably supported between gasket 9 and a transverse bearing surface 8*b* provided in case body 8. The portion of bezel 7 proximate bearing ring 11 is of a predetermined diameter for thereby providing that bearing ring 11 may be of larger diameter than instepped portion 7*a* of bezel 7 and surface 6*a* of crystal 6, respectively. The surface of bezel 7 substantially opposed to surface 7*c* thereof is provided with an instep arranged to receive a correspondingly configured gasket 10 which is abutted on the opposite side thereof by an arm of case body 8 along an abutment surface 8*a*.

Abutment surface 8*a* of case body 8 is substantially perpendicular to transverse bearing surface 8*b* thereof. Gasket 10, against which surface 8*a* abuts, may be fabricated of synthetic rubber, synthetic resin, or a material which is compressible diametrally inwardly between surface 7*d* of bezel 7 and abutting surface 8*a* of case body 8 for providing a water-tight seal therebetween. Additionally, the material of which gasket 10 is fabricated should provide friction between the surface between which it is correspondingly engaged for creating a stress therebetween for thereby strengthening the seal between case body 8 and bezel 7. Gasket 9 may be fabricated of synthetic rubber or synthetic resin which is similarly diametrally compressible between surface 6*a* of the crystal and the gasket seat of gasket 9 for thereby providing a water-tight seal therebetween.

Bearing ring 11 includes an angular surface 11*a* abutting gasket 9 and a transverse surface 11*b* for supporting crystal 6 along the margin of the underside surface thereof. As seen in FIG. 2, bearing ring 11 is located interiorly within the mounting relative to bezel 7 and is upstanding on transverse bearing surface 8*b* of case body 8.

In practice, to assemble the mounting, gasket 9 is seated in the gasket seat provided therefor in bezel 7 and crystal 6 is introduced upwardly into bezel 7 until chamfered edge 6*b* thereof abuts stepped portion 7*a* of bezel 7 and surface 6*a* of crystal 6 abuts gasket 9. It is desirable that gasket 9 have a planed lower edge into which bearing ring 11 abuts. Crystal 6 is therefore releasably secured between gasket 9 and stepped portion 7*a* of bezel 7. Gasket 10 is mounted on surface 7*d* of bezel 7 and bearing ring 11 is arranged on bearing surface 8*b* of case body 8, approximately at the midpoint thereof, and gasket 10 is forced into abutment with surface 8*a* of case body 8 by urging bezel 7 downwardly. However, care should be taken to prevent contact between surfaces 11*a* and 11*b* of bearing ring 11 and bezel 7.

According to the arrangement of parts, gasket 10 is securely fastened between case body 8 and bezel 7 for providing a strong, water-tight seal therebetween. Additionally, surface 11*b* of bearing ring 11 abuts the margin of the underside surface of crystal 6, while angular edge 11*a* thereof abuts gasket 9 and thereby prevents gasket 9 from being unseated from bezel 7.

In another embodiment of this invention, bearing ring 11 may support the gasket and crystal without any provision of a gasket seat therefor in the bezel. In this embodiment, it is preferable that the gasket be provided with an L-shape.

Accordingly, a compact wristwatch may be constructed with a mounting within the scope of the instant invention, while the water-tightness thereof is highly satisfactory. If desirable, the width of surface 11*b* of bearing ring 11 may be narrowed to merely support crystal 6. Under usual circumstances, bearing ring 11 is not highly visible because surface 6*b* of crystal 6 is chamfered, thereby providing a highly aesthetic plan view of the dial face of the watch.

Since gasket 9 is compressed among crystal 6, bearing ring 11 and bezel 7, it is substantially invisible through crystal 6. Moreover, the mounting may be assembled with facility and a broken crystal may be quickly and easily replaced therein, without any adhesive connection between any parts of the mounting.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also understood that the following claims are intended to cover all of the generic and specific features of the invention herein described, and all statements of the scope of the invention which, as a matter of language, might be said to fall therebetween.

What is claimed is:

1. An improved water-tight mounting for a timepiece comprising a transparent crystal having upper and lower surfaces, a case body for said timepiece underlying said crystal, said crystal being releasably mounted thereon, said crystal having a vertical peripheral surface substantially parallel to said timepiece axis and having a chamfered surface along an exterior edge of said upper surface thereof intercepting said vertical peripheral surface, a bezel releasably connecting said crystal to said case body, said bezel including a step overhanging said chamfered surface of said crystal, said step including a substantially linear edge releasably engaging said crystal along said chamfered surface thereof, said bezel including a gasket seat determined by a first annular groove interiorly located in an inner wall of said bezel and underlying said step provided therein, said crystal and bezel having a corresponding orientation such that said vertical peripheral surface of said crystal substantially overlies said gasket seat in said bezel, a first gasket mounted in said gasket seat so as to abut substantially the entire vertical peripheral surface of said crystal and protruding below said vertical peripheral surface of said crystal for abutting said lower surface of said crystal, said bezel having a second interiorly located annular groove in an outer wall of said bezel arranged below said first annular groove, a bearing ring upstanding on said case body having an outer wall substantially aligned with said vertical peripheral surface of said crystal but spaced from said inner wall of said bezel and including an angular edge at the peak of said outer wall thereof abutting said protruding portion of said first gasket, said case body including a transverse bearing surface on which said bearing ring is releasably supported in upstanding relationship solely against said protruding portion of said first gasket, and an arm issuing substantially upwardly from said case body substantially perpendicularly to said transverse bearing surface thereof, said arm terminating in an inwardly extending flange defining an interiorly located recess in said case body between said flange and said transverse bearing surface, and a second gasket having oppositely extending flanges at opposite ends thereof corresponding respectively to said second interiorly located annular groove in the outer wall of said bezel and said recess defined in said case body between said flange and transverse bearing surface thereof, said second gasket being mounted between said bezel and said case body under compression and said oppositely extending flanges at the opposite ends thereof being respectively releasably mounted in said second interiorly located annular groove in the outer wall of said bezel and said recess defined in said case body between said flange and transverse bearing surface thereof, said second gasket elevating said bezel off said transverse bearing surface of said case body.

* * * * *